US012715032B2

(12) United States Patent
Schmid

(10) Patent No.: US 12,715,032 B2
(45) Date of Patent: Aug. 25, 2026

(54) CONTROL DEVICE FOR SEALER

(71) Applicant: FERRUM PACKAGING AG, Schafisheim (CH)

(72) Inventor: Veit Schmid, Rombach (CH)

(73) Assignee: FERRUM PACKAGING AG, Schafisheim (CH)

( * ) Notice: Subject to any disclaimer, the term of this patent is extended or adjusted under 35 U.S.C. 154(b) by 475 days.

(21) Appl. No.: 18/218,520

(22) Filed: Jul. 5, 2023

(65) Prior Publication Data

US 2024/0024946 A1 Jan. 25, 2024

(30) Foreign Application Priority Data

Jul. 19, 2022 (EP) ..... 22185611

(51) Int. Cl.
*B21D 51/32* (2006.01)

(52) U.S. Cl.
CPC ..... *B21D 51/32* (2013.01)

(58) Field of Classification Search
CPC ..... B21D 51/26; B21D 51/30; B21D 51/32
See application file for complete search history.

(56) References Cited

U.S. PATENT DOCUMENTS 2,993,457 A 7/1961 Geeson et al.
5,299,899 A 4/1994 Katou et al.

FOREIGN PATENT DOCUMENTS

DE 4234115 A1 5/1996
DE 102017009856 A1 3/2019
WO 2021175407 A1 9/2021

OTHER PUBLICATIONS

European Search Report issued Jan. 2, 2023 in corresponding European Application No. 22185611.5.

*Primary Examiner* — Debra M Sullivan
(74) *Attorney, Agent, or Firm* — Spencer Fane, LLP

(57) ABSTRACT

A control device for a sealer for sealing a container includes a carrier element, a seaming curve arranged at the carrier element and having a curve track, a seaming device including a carrier shaft having a control end and a seaming end, the seaming device further including a control element arranged at the control end and a seaming lever arranged at the seaming end, and a first seaming roller for a first seaming operation and a second seaming roller for a second seaming operation are arranged at the seaming lever, the control element arranged in a movable manner in the curve track in such a way that the first seaming operation and the second seaming operation are capable of being controlled by the movement of the control element in the curve track.

14 Claims, 8 Drawing Sheets

--PRIOR ART--

--PRIOR ART--

--PRIOR ART--

CONTROL DEVICE FOR SEALER

CROSS-REFERENCE TO RELATED APPLICATION

This application claims priority to European Patent Application No. 22185611.5, filed Jul. 19, 2022, the contents of which are hereby incorporated by reference in its entirety.

BACKGROUND

Technical Field

The disclosure relates to a control device for a sealer and a sealer for sealing a container. The disclosure further relates to a method for sealing a container.

Background Information

During the filling of beverage cans or food cans, the cans pass through a can sealer after being filled with the beverage or foodstuff, whereby the filled can bodies enter via a feed path and can lids enter via a further feed path. The can sealer usually has several similar stations arranged in a carousel shape, in each of which a can is sealed with a can lid. The can lids are guided onto the can bodies and held on the can body by a seaming head. This holding also serves to fix the cans against breaking out of the circular path passed by the cans in the can sealer due to the centrifugal force. In the can sealer, the can bodies with the can lid are seamed over a seaming roller at the edges and thus sealed. Normally, the can with the can lid is additionally rotated around its own axis of symmetry by the seaming head. For rotation, the seaming rollers and seaming heads are arranged at a respective seaming shaft.

A generic can sealer is described in DE 749636 and DE4234115 A1. The can sealer comprises a clamping device for receiving a can to be sealed. In the operating state, the can to be sealed is introduced into the clamping device and secured by the clamping device in the axial and radial directions. A can lid is also introduced centered over the can opening of the can to be sealed. The can has a circumferential can flange in the area of the can opening and the can lid has a circumferential can lid flange. For sealing the can opening with the can lid, the can sealer additionally comprises two seaming rollers, mounted rotatably about an axis in each case, which seaming rollers press the can flange and the can lid flange together by a force acting substantially radially, the pressing being effected by a continuous rolling in the circumferential direction along the circumference of the can opening.

A further can sealer is known from GB 2098899 A. The can sealer comprises a clamping device for receiving the can to be sealed and a seaming roller. In the operating state, the can to be sealed is introduced into the clamping device and secured by the clamping device in the axial and radial directions. A can lid is also introduced centered over the can opening of the can to be sealed. The can has a circumferential can flange in the area of the can opening of the can body and the can lid has a circumferential can lid flange.

Before an actual seaming process, the lid and can are united at a defined point. Then, the can with the lid placed on it is clamped between a lifting station and the seaming head. During the entire seaming process, the can remains clamped and is only released again after the seaming process has been completed in order to enter a can exit. The actual seaming process is carried out by the seaming rollers, which are located on a seaming lever. The seaming rollers form the seam, thus forming a tight seal.

The lifting station, seaming head, seaming lever, and seaming rollers form a unit (also called a "station"). A plurality of these stations is circularly arranged in the can sealer (in a kind of carousel-like arrangement). The higher the number of stations, the more cans can be in the seaming process at the same time, which can increase the output (in can seals per hour).

The seaming process includes two operations: A pre-seam (operation one, also called "OP1" for short) and a final seam (operation two, also called "OP2" for short). These operations are carded out by sequentially pressing a first seaming roller for OP1 and a second seaming roller for OP2 against the can with the lid placed on it in the contact area between can and lid. By pressing the respective seaming roller, the material such as sheet metal of the lid and the can are seamed into each other.

To control these two seaming operations OP1 and OP2, known can sealers have a control device or controller.

For a better understanding of the present disclosure, a conventional control device known from the state of the art is described in the following on the basis of FIG. 1A-C.

For a better distinction of the known state of the art from the present disclosure, reference signs to features of known devices are provided with an inverted comma (in FIG. 1A-C) in the context of this application, whereas features to devices according to the disclosure or their components do not carry an inverted comma.

Thus, FIG. 1A-C show the known control device 1' for the seaming process of the sealer.

The control device 1' comprises a carrier element 2' and a seaming curve 4' arranged at the carrier element 2' and having a curve track 3' and a curve profile 5'.

To control the seaming process, a seaming device with a control element attached to a carrier axis is arranged in the curve track 3' and the control element is moved through the curve track in the operating state.

The seaming lever is arranged at the other end of the carrier axis, whereby the first seaming roller for the first seaming operation and the second seaming roller for the second seaming operation are arranged at the seaming lever.

The first seaming operation and the second seaming operation can be controlled by the movement of the control element in the curve track 3'.

In order to adapt the first seaming operation and the second seaming operation, the seaming curve 4' is connected to an adjustment mechanism 10', whereby the position of the seaming curve 4' can be displaced via the adjustment mechanism 4' such that an OP2 area 52' of the seaming curve 4' is located in such a way that the seaming rollers for the second seaming operation are positioned closer to or farther from the seam, depending on the seaming curve adjustment—i.e., can exert a lower or higher pressure on the scant. Thus, it is usually no longer necessary to adjust the seaming rollers for the second seaming operation individually at each station to the new requirements.

SUMMARY

It has been determined that this change in position of the entire seaming curve 4' by the adjustment mechanism 10' results not only in a change in position of the OP2 area 52', but inevitably also in a slight change in position of an OP1 area 51', since these areas are arranged on the same seaming curve 4' (The displacement of the seaming curve 4' about the pivot point 54 results not only in a change in position of the OP2 area 52', but also in a (smaller) change in position/distortion of the OP1 area 51').

The area of the curve track 3' in which the OP1 area 51' is located is slightly distorted for geometric reasons when the position of the OP2 area 52' is changed. In some cases, this led to the fact that the pre-seam is no longer produced correctly.

It is therefore an object of the disclosure to provide a controller or control device Which avoids the disadvantageous effects known from the state of the art. In particular, a control device is to be provided which is simply designed and can be easily and flexibly adapted.

The object is met by a control device (controller) according to the disclosure, a sealer according to the disclosure and a method according to the disclosure.

According to the disclosure, a control device for a sealer for sealing a container is proposed. The control device comprises a carrier element, a seaming curve arranged at the carrier element and having a curve track, and a seaming device.

The seaming device comprises a carrier shaft having a control end and a seaming end. In addition, the seaming device comprises a control element arranged at the control end of the carrier shaft and a seaming lever arranged at the seaming end of the carrier shaft.

Here, the seaming device further comprises a first seaming roller for a first seaming operation and a second seaming roller for a second seaming operation which are arranged at the seaming lever.

The control element is arranged in a movable manner in the curve track of the seaming curve in such a way that the first seaming operation and the second seaming operation can be controlled by the movement of the control element in the curve track.

In addition, the seaming curve comprises a first curve segment and a second curve segment, wherein the curve track is formed by the first curve segment and the second curve segment.

The first curve segment and the second curve segment can be moved (in particular can be displaced) independently of each other in such a way that the first seaming operation and the second seaming operation can be adjusted independently of each other (in particular by movement/the displacement of the first curve segment and the second curve segment).

By moving the first curve segment and/or the second curve segment, a shape of the curve track can be changed in particular. By changing the shape of the curve track, the first seaming operation and the second seaming operation can be adjusted, since the shape of the curve track is responsible for a control of the first and second seaming operation.

In particular, a pre-seam is formed by the first seaming operation (hereinafter also designated as "OP1") and a final seam is formed by the second seaming operation (hereinafter also designated as "OP2"). These operations can be performed by sequentially pressing the first seaming roller for the first seaming operation and the second seaming roller for the second seaming operation against the container with the lid placed on it in the contact area between container and lid.

By pressing the respective seaming roller, the material is seamed into each other.

In the context of the disclosure, can be moved independently of each other means in particular that the first curve segment can be moved without moving the second curve segment and/or that the second curve segment can be moved without moving the first curve segment.

In the context of the disclosure, can be adjusted independently of each other means in particular that the first seaming operation can be adjusted without changing the second seaming operation and/or the second seaming operation can be adjusted without changing the first seaming operation. This is made possible in particular by the fact that both the first curve segment and the second curve segment can change its position (particularly preferably its position relative to/at the carrier element) without changing a position of the respective other curve segment. In particular, this enables the first seaming roller and/or the second seaming roller to be positioned closer or farther to a seam of the container in an operating state, i.e., the feed of the first and second seaming rollers can be adjusted independently of each other. In particular, the seaming rollers are each positioned farther or closer to the seam in order to exert a lower or higher pressure on the seam.

Preferably, the shape of an area of the curve track responsible for the corresponding seaming operation is changed by the change in position of the first or second curve segment.

The carrier element is in particular the part of the device via which the control device is attached/arranged in a sealer. The carrier element can be stationary, i.e., immovable. The seaming curve is in particular the part of the device by which the movement of the seaming rollers in the sealer is predetermined, i.e., controlled. The seaming device is in particular the part of the device with which the container is sealed.

In principle, the curve track can be formed by any plurality of curve segments but is formed by at least the first curve segment and the second curve segment.

Particularly preferred, the first curve segment and the second curve segment can be moved independently of each other in such a way that a curve profile (i.e., the shape) of the curve track can be changed. The curve profile is in particular the profile along which the control element can be moved. In particular, the first seaming operation and the second seaming operation can be adjusted by changing the curve profile due to the displacement of the first curve segment and the second curve segment.

Since the seaming lever and thus the seaming rollers are connected to the control element via the carrier shaft, the seaming lever and the seaming rollers are also moved accordingly during a movement along the curve profile.

The control element can in particular comprise a curve roller (or also a plurality of curve rollers, particularly preferably a first and a second curve roller), which curve roller/curve rollers can be unrolled, i.e., can be rolled off, during the movement through the curve track along the curve profile.

The curve track can have a first section for controlling the first seaming operation and a second section for controlling the second seaming operation (i.e., the responsible areas mentioned above).

The curve track is preferably designed as a circular path, a circuit, or a revolving curve track in which the control element can be moved endlessly in one direction (or along which the seaming device can be moved endlessly in one direction).

Here, the control device can comprise a plurality of seaming devices which are arranged at a single seaming curve, i.e., guided in a single curve track.

In an embodiment of the disclosure, the first curve segment can be movable in such a way that a position of the first section relative tout the carrier element can be changed. As a result, a first feed of the first seaming roller (and thus the first seaming operation) to the container may be adjustable by a change in the position of the first section.

In addition, or alternatively, the second curve segment can be movable in such a way that a position of the second section relative to/at the carrier element can be changed. As a result, a second feed of the second seaming roller (and thus the second seaming operation) to the container may be adjustable by a change in the position of the second section. Thus, the first section can be moved independently of the second section and in particular relative tout the carrier element. Furthermore, the second section can be moved independently of the first section and in particular relative to/at the carrier element.

In an embodiment of the disclosure, the seaming device can be movable relative to the carrier element by the movement of the control element in the curve track.

In practice, the carrier shaft can extend along a carrier axis from the control end to the seaming end and a torque acting substantially perpendicular to the carrier axis can be exerted on the carrier shaft by the movement of the control element, so that the seaming lever can be moved by the carrier shaft by the control device. Alternatively, the control element can be moved in the curve track by a torque acting on the carrier shaft. For this purpose, either the control element or the carrier shaft can be coupled to a rotor of the sealer so that the movement takes place due to a rotation of the rotor in the operating state.

In a particularly preferred embodiment, the first and/or the second seaming roller is arranged in a rotatable manner at the seaming lever. For this purpose, the seaming rollers can each be arranged at/attached to a rotatable seaming roller pin, which is fixed/clamped to the seaming lever.

Due to the measures described above, the control device according to the disclosure not only solves the problem of the distorted OP1 area in the case of OP2 position displacement, but also combines further functions which enable more varied seaming adjustments.

The control device according to the disclosure provides in particular a complete mechanical motion separation from the OP1 area (i.e., the first section) to OP2 area (i.e., the second section). The control device according to the disclosure is designed in such a way that the OP2 area can be displaced in its position—without influencing the OP1 area.

The solution according to the disclosure now no longer consists of a single curve that undergoes a change in position, but of (at least) two segments—the first and second curve segment—which can be moved completely independently of each other. This means in particular the first curve segment for the first seaming operation and the second curve segment for the second seaming operation. Both are preferably directly connected to a curve carrier—the carrier element—and can each be moved from the carrier element. Particularly preferably the curve segments can each be moved from the carrier element via servomotors with gears, in particular by an eccentric cam arranged on each of the first and second curve segments.

According to the disclosure, a sealer for sealing the container is further proposed, which comprises the control device according to the disclosure.

Preferably, the sealer comprises a sealing station comprising the control device and having a lifting station for receiving the container. By clamping the container between the seaming head and the lifting station, the container can be rotated and sealed by the seaming rollers.

Here, the sealing station can comprise the rotor mentioned above.

In addition, the sealer can comprise a container feed for the containers, in particular containers filled with a product, to the sealing station (or for feeding the container to a working space of the sealer) and a feeding device for guiding the lids to the container. In addition, the sealer according to the disclosure can comprise an outlet for sealed containers from the sealing station.

Particularly preferred, the sealing station of the sealer can comprise a lifting station, a seaming head, a seaming lever, and seaming rollers as a unit e.g., the station. A plurality of the stations can be circularly arranged in the sealing station of the sealer (in a kind of carousel-like arrangement/carousel). The higher the number of stations, the more cans can be in the seaming process at the same time, which can increase the output (in can seals per hour).

According to the disclosure, a method for sealing the container with the lid is further proposed. The method according to the disclosure comprises providing the sealer according to the disclosure, placing the lid on an opening of the container and sealing the container with the lid by the/in the sealing station.

Here, the container can be clamped between the seaming head and the lifting station, and the lid can be seamed to the container by the first seaming roller, second seaming roller and seaming head. Finally, the sealed container can be discharged from the working space of the sealer.

The working space is the space of the sealer in which the container is preferably sealed with the lid, in particular the space in which the seaming process takes place. Preferably, the working space is surrounded by a housing and thus delimits the working space of the sealer (and thus enables the formation of a hygiene zone).

In particular, the housing can be considered as a cladding, enclosure, casing, or sheath which at least partially surrounds the working space. The housing can close off and/or shield the working space from the outside, so that an atmosphere in the working space is hygienically separated from the environment.

The sealer according to the disclosure can further comprise the lifting station (or a plurality of lifting stations) for lifting the container. The lifting stations may be arranged opposite the seaming devices.

In practice, the sealer can comprise a container discharge for discharging the containers from the working space. A separating wall or blind can be arranged between the container feeder and the container discharge, which prevents a cross-contamination between the incoming and outgoing containers.

In addition, the container feeder can be designed as an infeed table known in the state of the art.

The sealer according to the disclosure is preferably designed as a can sealer. The can sealer usually has the several similar stations arranged in a carousel shape, in which a can is sealed in each case with a can lid.

Here, the container can be a can and the lid can be a can lid, which are seamed together by the can sealer.

In the operating state, the seaming rollers with their respective seaming profile are brought into contact with a can lid flange of the can lid and a can flange of the can. By rotating the can, the seaming roller is then rotated in the circumferential direction of the can, thereby seaming the can flange with the can lid flange. For rotation of the can, the can is preferably clamped between the seaming head and the lifting station whereby the seaming head is rotated about a seaming axis by a seaming shaft. Preferably, the can is thus fixed in the axial and radial direction for sealing and is rotated in the circumferential direction.

In the context of the disclosure, the can can be understood to be a rotationally symmetrical container which is sealed by the can sealer and the associated seaming roll. A can can preferably comprise a metal, in particular aluminum or steel.

In principle, the sealer can preferably comprise at least the first seaming roller and the second seaming roller as two types of seaming rollers with different seaming profiles, so that cans can be sealed according to a double-seam principle, in which the cans are sealed in two steps. One type of seaming roller is responsible for each step. The first seaming roller makes the pre-seam (first seaming operation), while the second type of seaming roller completely seals the can/the package (second seaming operation).

The can bodies are fed by the container feeder. The can bodies pass from the container feeder to one of the respective lifting stations (which are integrated in the sealing station). On one revolution of the sealing station, the lifting stations perform the curve-controlled lifting movement to feed the cans from below to the can lid and later to the seaming head. After a certain lifting distance, the can body comes into contact with the can lid.

Preferably, the can sealer still comprises an ejection element. For example, the ejection element is attached to an ejection rod, which performs a linear movement along the axial direction within the seaming shaft of the seaming head. Preferably curve-controlled (via a separate curve of the control device), the can lid is first held in a lid guide during the downward movement. As soon as the can body is moved in the can lid, the ejection element changes the direction of the lift and moves upwards evenly with the lifting station. The supporting function of the ejection element ends with the movement into the seaming head of the can body and the can lid. From this moment, the can is clamped between the lifting station and the seaming head. Subsequently, the actual seaming process is carried out.

In principle, the sealer according to the disclosure can be analogous to the can sealers already known from the state of the art but differs in the control device, to avoid the disadvantages of the state of the art in this way.

BRIEF DESCRIPTION OF THE DRAWINGS

In the following, the embodiments of the invention and the state of the art are explained in more detail based on embodiments with reference to the drawings.

DETAILED DESCRIPTION

Figure 1A:
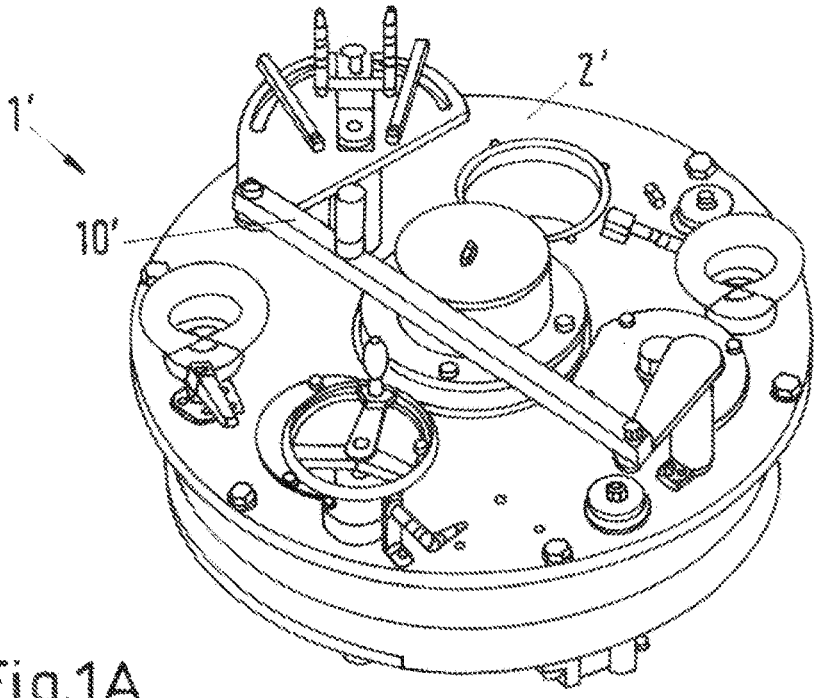
FIG. 1A illustrates a first view of a control device of the state of the art.
Figure 1B:
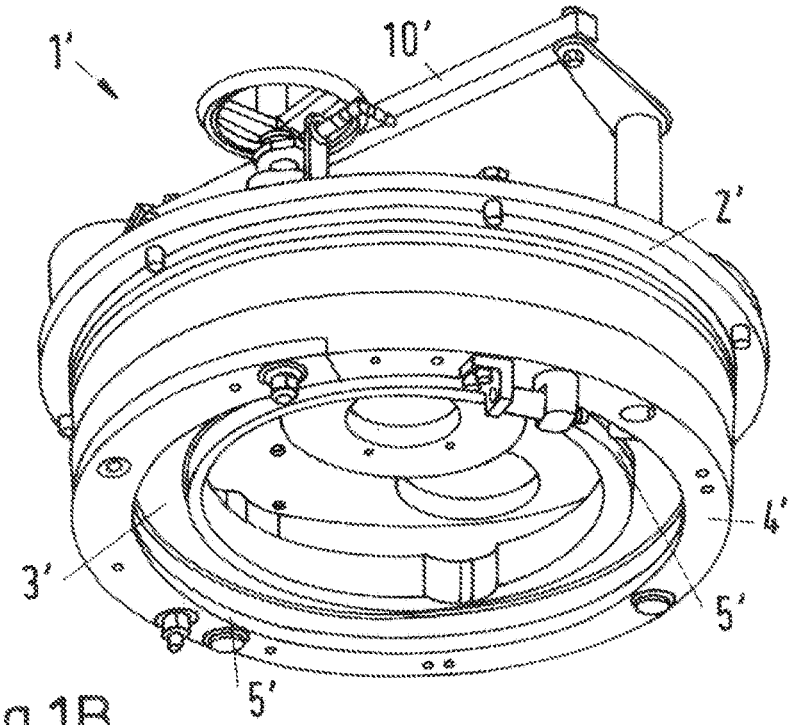
FIG. 1B illustrates a second view of the control device of the state of the art.
Figure 1C:
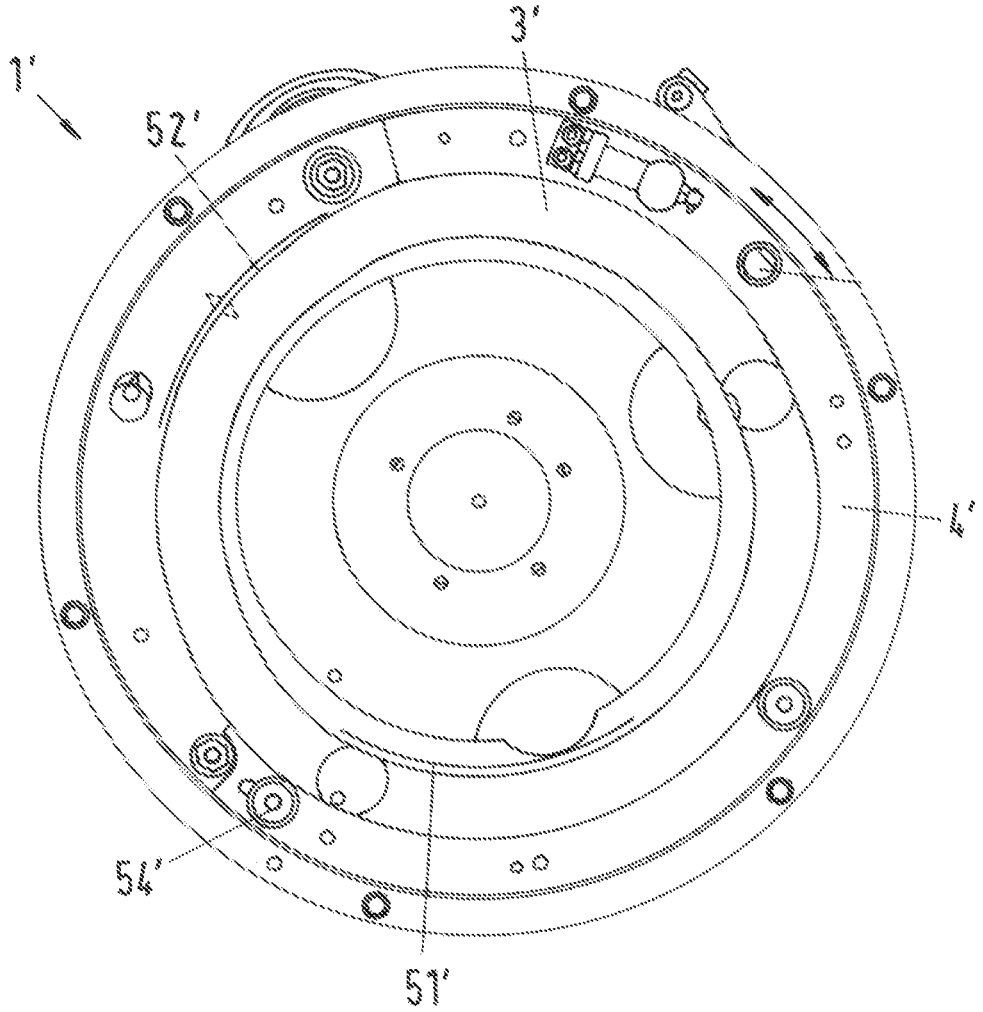
FIG. 1C, illustrates a third view of the control device of the state of the art.

FIG. 1A-C have already been described above in the representation of the state of the art.

Figure 2:
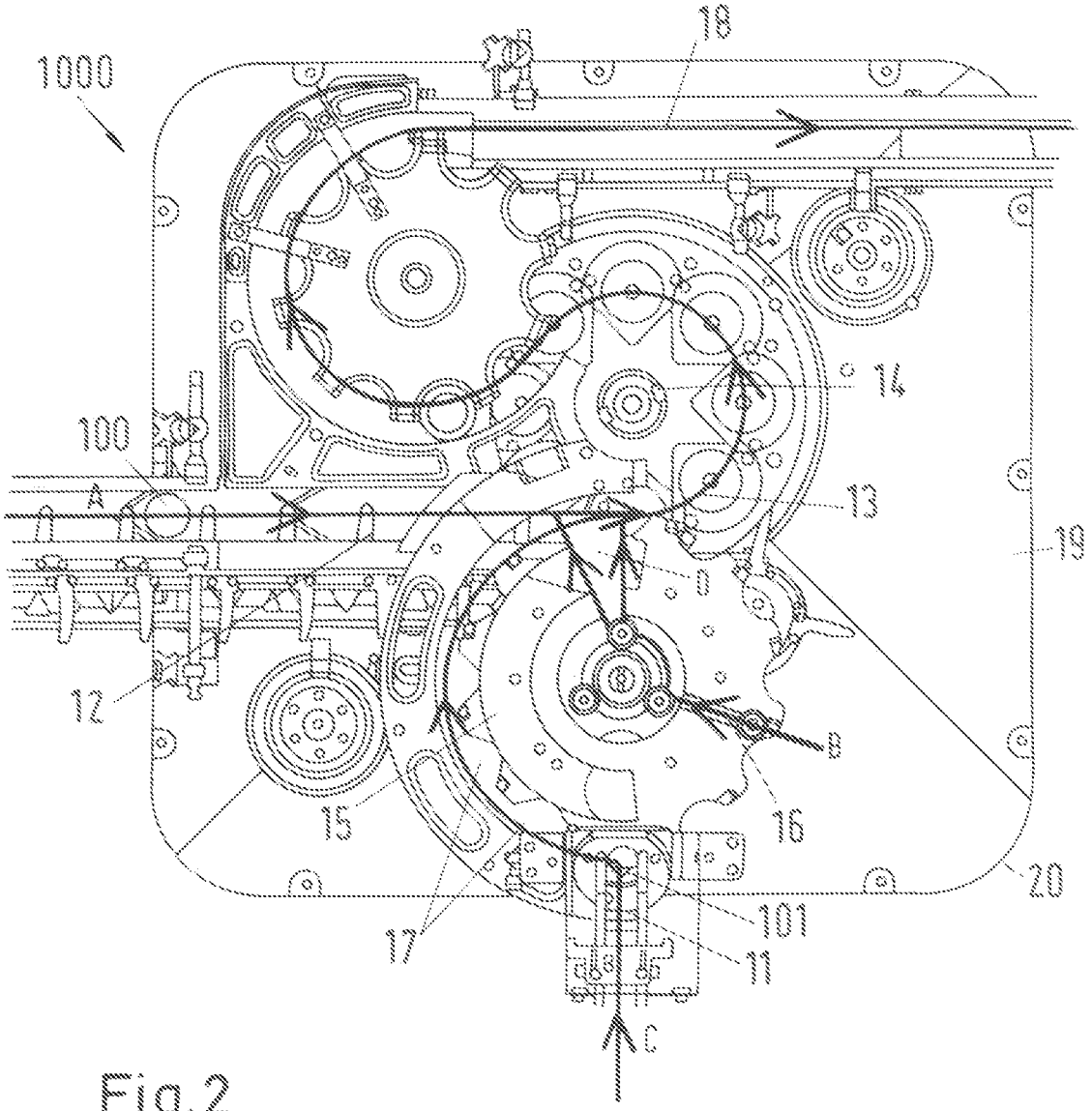
FIG. 2 illustrates a plan view of a can sealer according to the disclosure.

FIG. 2 shows a plan view of a can sealer 1000 according to the disclosure. In principle, the sealing process is analogous to the state of the art, but the can sealer 1000 has a control device according to the disclosure.

The can sealer 1000 according to FIG. 2 comprises a lid providing device 11 for providing a lid 101, a gassing rotor 15 for supplying gas to the can 100 and for guiding and transporting the lid 101 to the can 100. In addition, the sealer 1000 comprises a sealing station 14 for sealing the can 100 with the lid 101. Thereby, the sealing station 14 is arranged in a working space 19 of the can sealer 1000 surrounded by a housing 20.

The lid 101 is introduced by the lid providing device 11 into the working space 19 of the can sealer 1000 along the arrow C. In this process, the lids 101 are placed on the gassing rotor 15. By rotation of the gassing rotor 15, the lids 101 are transported further.

The cans 100 are guided from a container dispenser in the direction of arrow A to the working space 19 by carriers of the container feed 12 arranged at a chain. There, the containers 100 are introduced into the container receptacles 17 of the gassing rotor 15. There, the can 100 is gassed in area D with a gas such as carbon dioxide or nitrogen and united with the lid 101.

The gassing is carried out along the arrow B by the gas supply 16 via the gassing rotor 15. After gassing, the can 100 with the lid 101 is guided further by the container transfer 13 from the gassing rotor 15 to the seaming process 14 and is sealed there. As an alternative to the gassing rotor 15, a lid rotor with rails can also be used for transporting the lids, whereby the gassing is carried out via a linear gassing device, which is arranged stationary.

Cans 100 with lids 101 are clamped and sealed by the seaming process 14. The sealed can is conveyed by a further rotor into the can outlet 18.

During gassing, the gas is conveyed to an underside of the lid 101. In this way, it can be ensured that a residual volume of the can 100 in which no foodstuff is arranged is substantially filled with the gas before sealing, whereby the air originally present in the residual volume is displaced as completely as possible by the gas. In this way, it may be possible to achieve a longer shelf life for the foodstuff arranged in the can 100.

Figure 3:
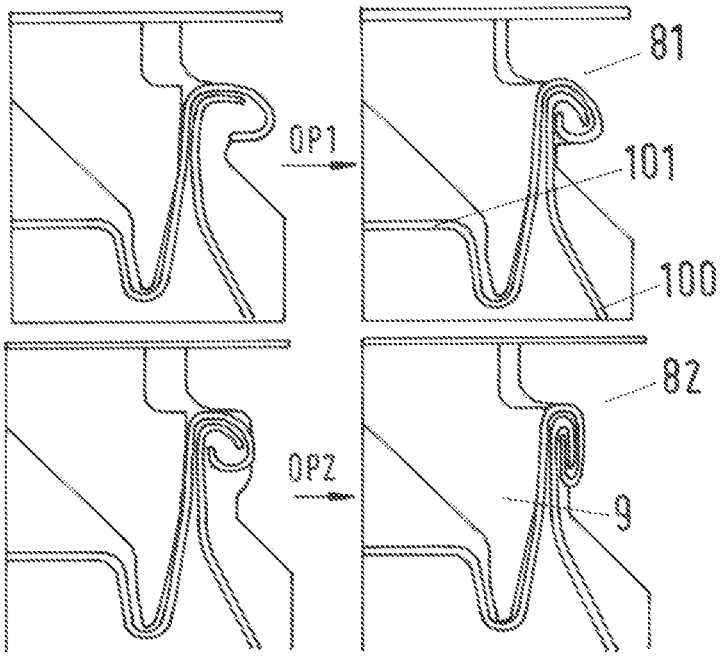
FIG. 3 illustrates a representation of a first and second seaming operation.

FIG. 3 shows a representation of a first seaming operation OP1 and a second seaming operation OP2.

A seaming process according to the disclosure includes two operations: A pre-seam (by "OP1") and the final seam (by "OP2"). These operations OP1 and OP2 are carried out by sequentially pressing the first seaming roller 81 and the second seaming roller against the can 100 with the lid 101 placed on it in the contact area between can 100 and lid 101. By pressing the respective seaming roller 81, 82, the sheet metal of the lid 101 and the can 100 are seamed into each other.

Figure 4:
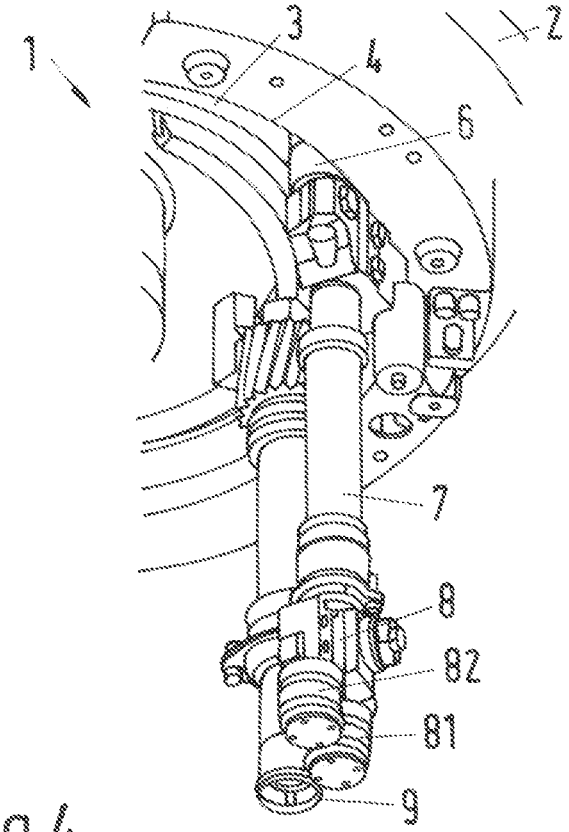
FIG. 4 illustrates a perspective view of an interaction of a control device according to the disclosure with a seaming device.

FIG. 4 shows a perspective view of an interaction of a control device 1 according to the disclosure with a seaming device.

The control device 1 comprises a carrier element 2, a seaming curve 4 arranged at the carrier element 2 and having a curve track 3 and a seaming device.

Here, the seaming device comprises a carrier shaft 7 in the form of a lever shaft mechanism 7 with a control end and a seaming end. In addition, the seaming device comprises a control element 6 arranged at the control end of the carrier shaft 7 and a seaming lever 8 arranged at the seaming end of the carrier shaft 7.

Here, the control element 6, which is designed as a curve roller 6, can be moved by rolling in the curve track 3 of the seaming curve 4 a in such a way that the first seaming operation and the second seaming operation can be controlled by the movement of the control element 6 in the curve track 3. Thus, it can be controlled when which seaming roller 81, 82 acts on the can and lid.

The first seaming roller 81 and the second seaming roller 82 are attached in the seaming lever 8. This is curve-controlled by the lever shaft mechanism 7 and curve roller 6 via the seaming curve 4. As a result, the seaming curve 4 controls the sequential pressing of the seaming rollers 81, 82 to form the seam.

If different can materials and/or lid materials (material type, wall thickness) are sealed on a sealer, the second seaming rollers 82 for the second seaming operation (and in rare cases the first seaming rollers 81 for the first seaming operation) of all seaming stations must be adjusted to changed can materials/lid materials with every can material and/or lid material change.

Figure 5A:
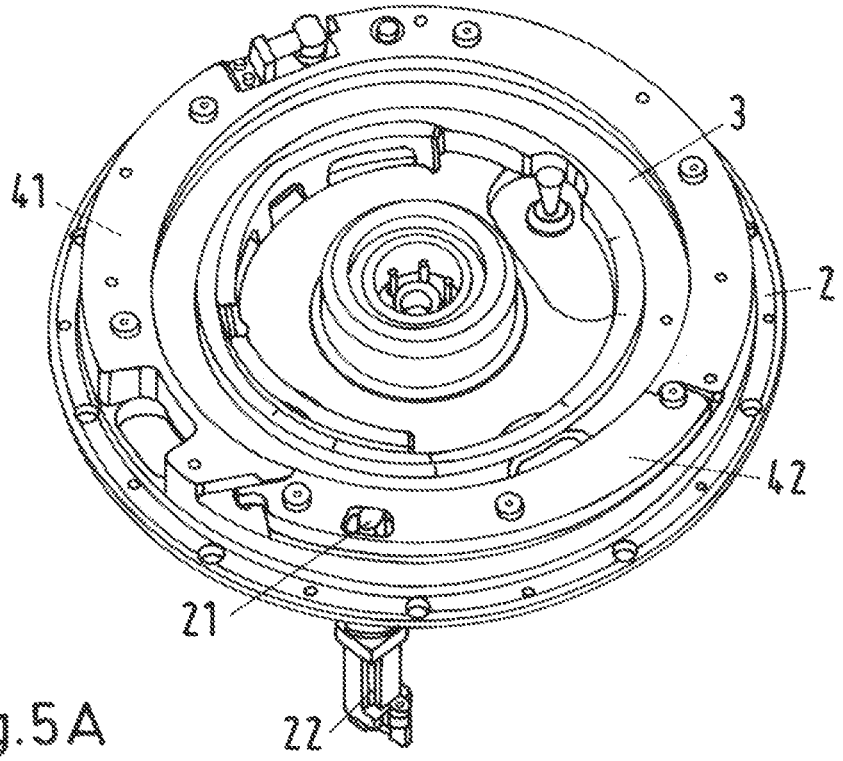
FIG. 5A illustrates a first view of a carrier element according to the disclosure with a first curve segment and a second curve segment.
Figure 5B:
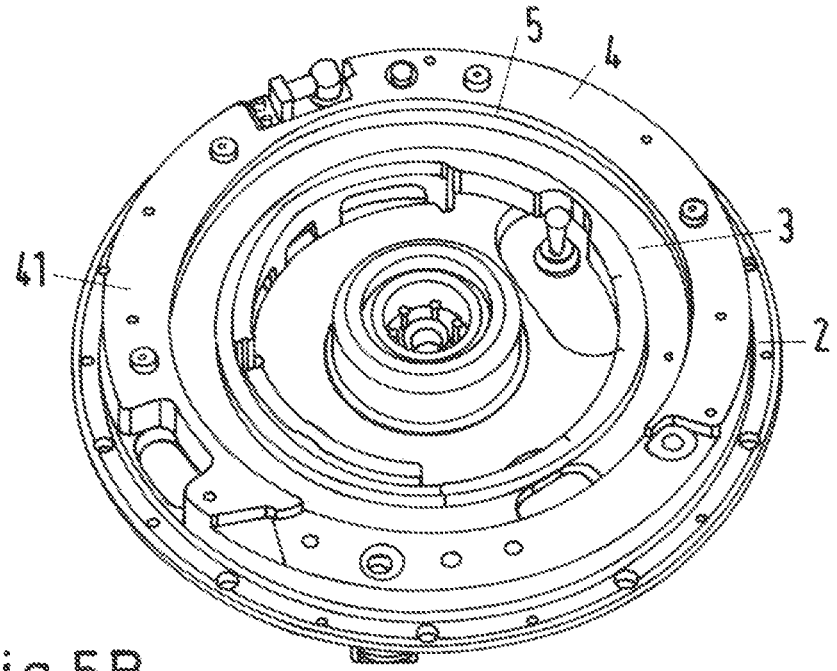
FIG. 5B illustrates a second view of the carrier element according to the disclosure with a first curve segment.
Figure 5C:
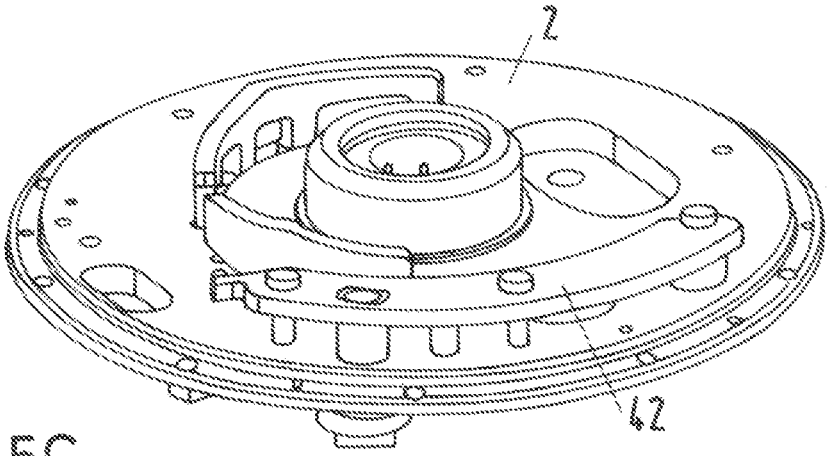
FIG. 5C illustrates a third view of the carrier element according to the disclosure with a second curve segment.

FIG. 5A-C show views of the carrier element 2 according to the disclosure with a first curve segment 41 and a second curve segment 42.

The curve track 3 is formed by the first curve segment 41 and the second curve segment 42. The first curve segment 41 and the second curve segment 42 can be displaced independently of each other in such a way that the first seaming operation and the second seaming operation can be adjusted independently of each other by the displacement of the first curve segment 41 and the second curve segment 42, since a curve profile 5 of the curve track 3 can change at different sections.

In this case, can be displaced independently of each other means in particular that the first curve segment 41 can be moved without moving the second curve segment 42 and that the second curve segment 42 can be moved without moving the first curve segment 41, since the curve segments 41, 42 are attached to the carrier element 2 independently of each other.

In this way, the first seaming roller or the second seaming roller can be closer or farther to a seam of the container in an operating state, i.e., the feed of the first and second seaming roller can be adjusted independently of each other.

All the adjustments described here can be actuated electrically with servomotors via gears. In doing so, the servomotor 22 can displace the second curve segment 42 via the eccentric cam 21.

The solution according to the disclosure is thus made up of two segments 41, 42, which can be displaced completely independently of each other.

Figure 6A:
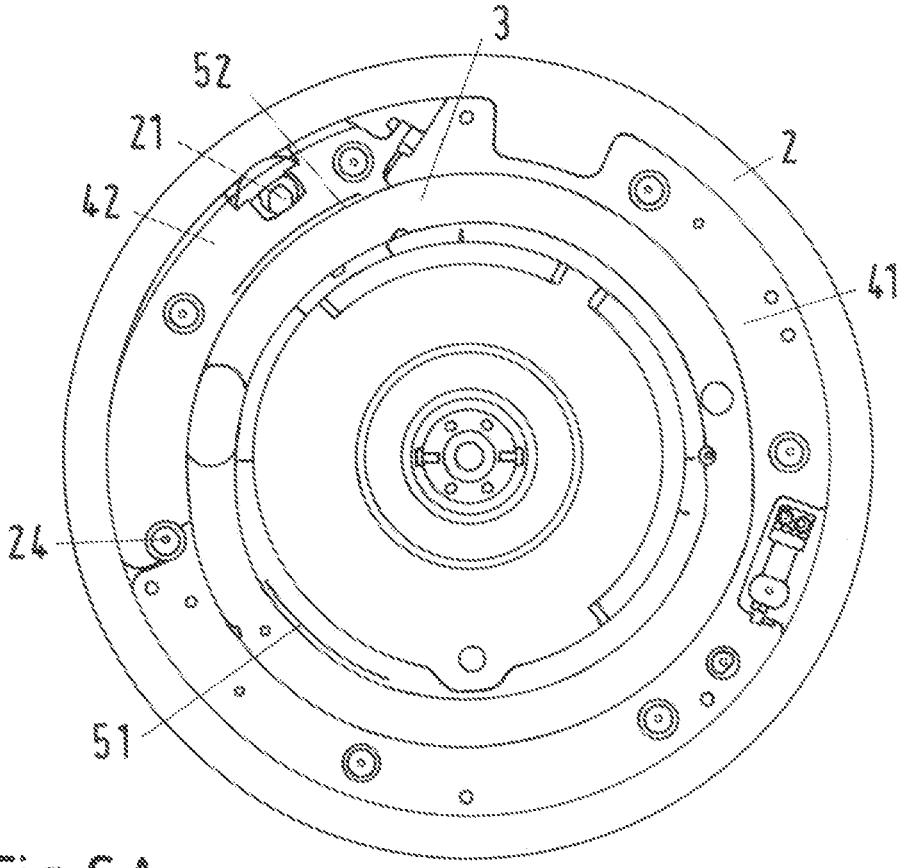
FIG. 6A illustrates a first view from below of a carrier element according to the disclosure with a first curve segment and a second curve segment.
Figure 6B:
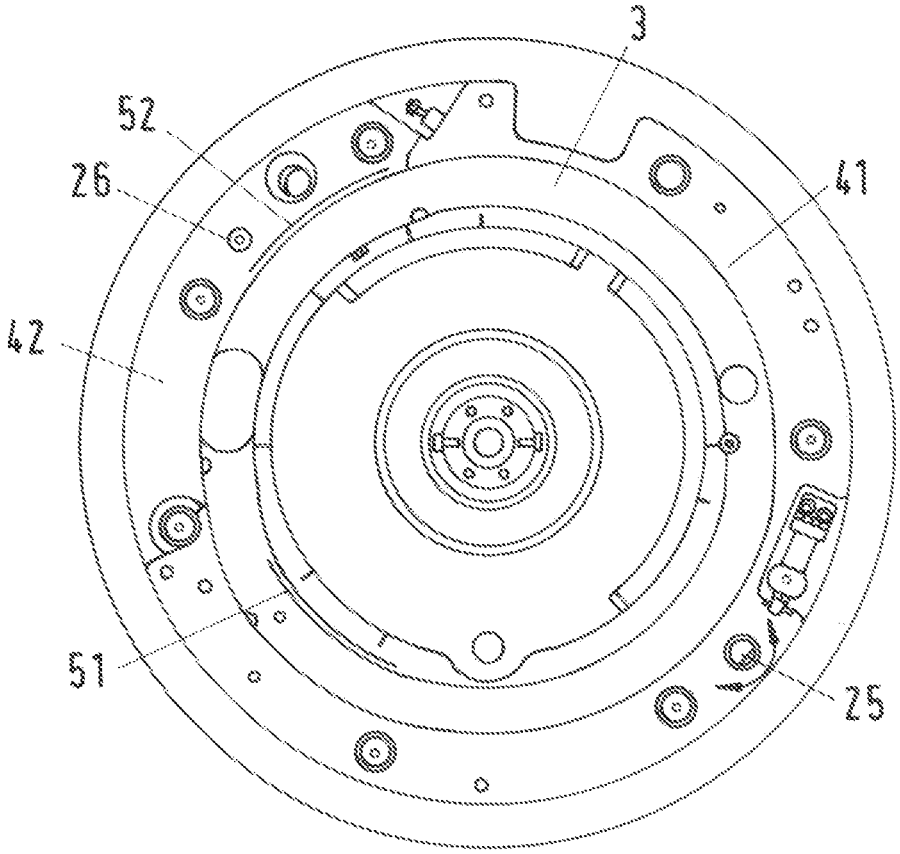
FIG. 6B illustrates a second view from below of the carrier element according to the disclosure with the first curve segment and the second curve segment.

FIG. 6A-B show views from below of a carrier element 2 according to the disclosure with a first curve segment 41 and a second curve segment 42.

The device according to the disclosure not only solves the basic problem of the distorted OP1 area, i.e., a first section 51 with OP2 area position displacement (i.e., a displacement of a second section 52), but also combines further functions which enable more varied seaming adjustments.

The disclosure offers a completely mechanical movement separation from OP1 area 51 to OP2 area 52. The system is designed in such a way that OP2 area 52 can be displaced in its position—without affecting OP1 area 51.

In addition, it is possible to displace the position of the OP1 area 51 in addition to the position of the OP2 area 52—and this completely independently of the displacement of the OP2 area 52.

An OP2 setting mechanism (in the form of an eccentric cam 21) is used not only to adjust an OP2 seam (i.e., final seam), but also to enable a so-called "disengaging function" of the OP2 area 52. This means that the OP2 area 52 is moved so far outwards that the second seaming roller can no longer exert any force on the seam.

This disengagement of the OP2 area 52 now enables a pre-seam analysis and pre-seam adjustments of the first seaming rollers despite mounted second seaming rollers (since these now have no influence on the seam). A pre-seam (i.e., OP1 seam) can now be examined separately in order to adjust it if necessary.

Due to this combination of these two functions (OP2 adjustment and disengagement) made possible according to the disclosure, costs, number of parts and time required for putting into operation can be reduced.

The displacement of the second curve segment 42 about the pivot point 24 via the OP2 eccentric cam 21, results in a change in position of the OP2 area. 52 and is used for the global setting/adjustment of the OP2 seam (i.e., for any plurality of seaming devices arranged at the seaming curve) without having to adjust/to set the second seaming rollers of each station separately at great effort. The curve track 3 of the OP1 area 51 of the first curve segment 41 is not affected with this adjustment of the OP2 area 52 due to the mechanical motion separation included in the present disclosure.

The displacement of the first curve segment 41 about the pivot point 26 via the OP1 eccentric cam 51 driven by a servo motor with gearbox, results in a change in position of the OP1 area 51 and is used for the global setting/adjustment of the OP1 seam (i.e., for any plurality of seaming devices arranged at the seaming curve)—without having to adjust/to set the first seaming rollers of each station separately at great effort. The OP1 seam is controlled by the first curve segment 51. The curve track 3 of the OP2 area 52 of the second curve segment 42 is not affected with this adjustment of the OP1 area 51 due to the mechanical motion separation included in the present disclosure.

Figure 7:
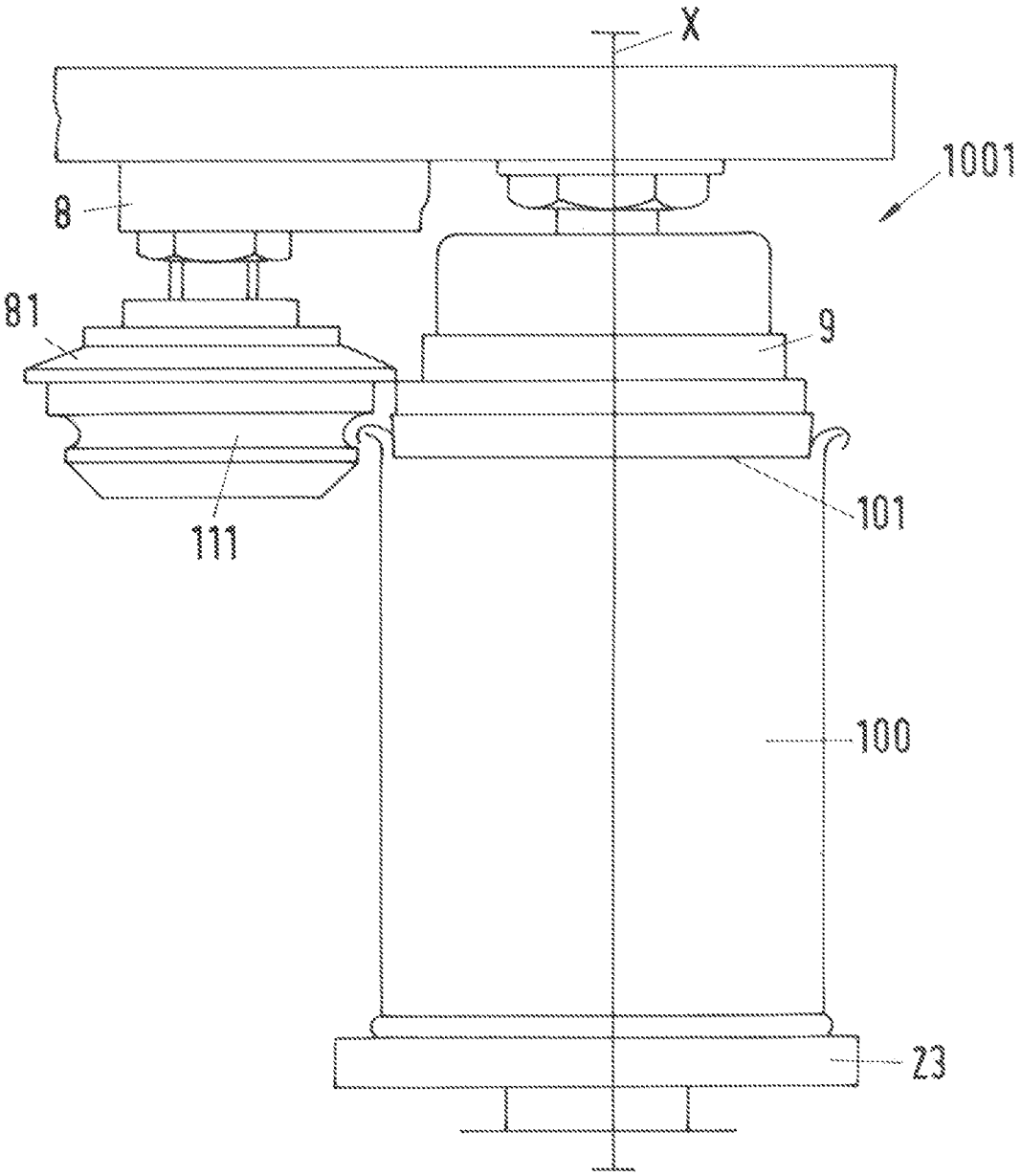
FIG. 7 illustrates a schematic representation of a sealing station.

FIG. 7 shows a schematic representation of a sealing station 1001 with a can 100 to be sealed and a can lid 101, in which the control device according to the disclosure is not represented with the individual components.

The sealing station 1001 comprises a can support with lifting station 23 and a seaming head 9, and a seaming roller 81 rotatably mounted about a seaming shaft and having a seaming roller profile 111. The can lid 101 is arranged centered above the opening of the can 100. The can 100 has a circumferential can flange in the area of the can opening, and the can lid 101 has a circumferential can lid flange.

During the sealing process, the seaming roller 81 is brought into contact with the can flange and the can lid flange via the seaming roller profile 111. In this process, the can flange and the can lid flange are pressed together via the seaming roller 81 by a force acting substantially radially. The pressing is effected by a continuous rolling of the seaming roller 81 in the circumferential direction along the circumference of the can opening. A double seam is preferably produced by seaming the can 100 with the can lid 101. For this purpose, however, a second seaming roller not represented here is used.

For seaming, the can 100 is rotated by a clamping device made up of a lifting station 23 and a seaming head 9, by rotating the seaming head 9 by the seaming shaft about the seaming axis X.

The disclosure is not limited to the disclosed embodiments. Other variations of the disclosed embodiments may be understood and effected by persons skilled in the art in practicing a claimed disclosure from a study of the drawings, the disclosure, and the dependent claims. In the claims, the word "comprising" does not exclude other elements or steps, and the indefinite article "a" or "an" does not exclude a plurality. The mere fact that certain measures are repeated in mutually different dependent claims does not mean that a combination of these measures cannot be advantageously used. Any reference signs in the claims should not be interpreted as limiting the scope.

Particularly preferred embodiments of the disclosure relate to a control device which comprises a plurality of seaming devices which are arranged on a single seaming curve, i.e., are guided in a single curve track.

The invention claimed is:

1. A control device for a sealer for sealing a container, comprising:

a carrier element;

a seaming curve arranged at the carrier element and having a curve track;

a seaming device comprising a carrier shaft having a control end and a seaming end, the seaming device further comprising a control element arranged at the control end and a seaming lever arranged at the seaming end; and a first seaming roller for a first seaming operation and a second seaming roller for a second seaming operation are arranged at the seaming lever, the control element arranged in a movable manner in the curve track in such a way that the first seaming operation and the second seaming operation area capable of being controlled by the movement of the control element in the curve track, the seaming curve comprising a first curve segment and a second curve segment, the curve track being formed by the first curve segment and the second curve segment, the curve track being formed by the first curve segment and the second curve segment, and the first curve segment and the second curve segment are configured to be moved independently of each other in such a way that the first seaming operation and the second seaming operation are capable of being adjusted independently of each other.

2. The control device according to claim 1, wherein the first curve segment and the second curve segment are capable of being moved independently of each other in such a way that a curve profile of the curve track is capable of being changed.

3. The control device according to claim 2, wherein the control element comprises a curve roller configured to be rolled during the movement through the curve track along the curve profile.

4. The control device according to claim 1, wherein the curve track has a first section configured to control the first seaming operation and a second section configured to control the second seaming operation.

5. The control device according to claim 4, wherein the first curve segment is capable of being moved in such a way that a position of the first section on the carrier element is capable of being changed.

6. The control device according to claim 5, wherein a first feed of the first seaming roller to the container is capable of being adjusted by changing the position of the first section.

7. The control device according to claim 4, wherein the second curve segment is capable of being moved in such a way that a position of the second section on the carrier element can be changed.

8. The control device according to claim 7, wherein a second feed of the second seaming roller to the container is capable of being adjusted by changing the position of the second section.

9. The control device according to claim 1, wherein the seaming device is capable of being moved relative to the carrier element by the movement of the control element in the curve track.

10. The control device according to claim 1, wherein the carrier shaft extends along a carrier axis from the control end to the seaming end and a torque acting substantially perpendicular to the carrier axis is capable of being exerted on the carrier shaft by the movement of the control element, so that the seaming lever is capable of being moved by the carrier shaft.

11. The control device according to claim 1, wherein the first or the second seaming roller are arranged in a rotatable manner on the seaming lever.

12. A sealer for sealing a container, comprising:

a sealing station comprising the control device according to claim 1 and having a lifting station configured to receive the container;

a container feed configured to feed containers to the sealing station;

a feeding device configured to guide a lid to the container; and an outlet from the sealing station for sealed containers.

13. A method for sealing a container with a lid, comprising:

providing a sealer according to claim 12;

placing the lid on an opening of the container; and sealing the container with the lid.

14. The method according to claim 13, wherein the sealing of the container comprises positioning the container between a seaming head and the lifting station; and seaming the lid to the container by the first and second seaming roller.

* * * * *